US008579258B2

(12) United States Patent
Ayana

(10) Patent No.: US 8,579,258 B2
(45) Date of Patent: Nov. 12, 2013

(54) INTEGRAL LOAD SUPPORT FOR A JACK FORMED OF A SHEET MATERIAL BENT TO LESS THAN 180°

(75) Inventor: Cem Güney Ayana, Eskisehir (TR)

(73) Assignee: Arikan Kriko ve Makina Sanayi Ticaret Anonim Sirketi (TR)

( * ) Notice: Subject to any disclaimer, the term of this patent is extended or adjusted under 35 U.S.C. 154(b) by 131 days.

(21) Appl. No.: 13/128,704

(22) PCT Filed: Oct. 28, 2009

(86) PCT No.: PCT/TR2009/000132

§ 371 (c)(1), (2), (4) Date: May 11, 2011

(87) PCT Pub. No.: WO2010/056218

PCT Pub. Date: May 20, 2010

(65) Prior Publication Data

US 2011/0210297 A1 Sep. 1, 2011

(30) Foreign Application Priority Data

Nov. 11, 2008 (TR) ..... a 2008 08531

(51) Int. Cl.
*B66F 3/12* (2006.01)

(52) U.S. Cl.
USPC ..... 254/28; 254/133 R

(58) Field of Classification Search
USPC ..... 254/122–126, 133 R, 134, 128, 2 B
See application file for complete search history.

(56) References Cited

U.S. PATENT DOCUMENTS

| | | | | |
|---|---|---|---|---|
| 5,135,201 | A * | 8/1992 | Engel et al. | 254/126 |
| 5,516,066 | A | 5/1996 | Fabiano et al. | |
| 5,697,598 | A * | 12/1997 | Fabiano et al. | 254/126 |
| 5,782,457 | A * | 7/1998 | Arguelles | 254/126 |
| 5,979,877 | A * | 11/1999 | Arguelles | 254/126 |
| 6,022,001 | A | 2/2000 | Palacio et al. | |
| 6,974,124 | B1 | 12/2005 | Alvarez Oronoz | |
| 2008/0272349 | A1 | 11/2008 | Alluru et al. | |

FOREIGN PATENT DOCUMENTS

| | | | |
|---|---|---|---|
| EP | 0744375 | A1 | 11/1996 |
| JP | 2007-230758 | A | 9/2007 |

* cited by examiner

*Primary Examiner* — Lee D Wilson
*Assistant Examiner* — Henry Hong
(74) *Attorney, Agent, or Firm* — Akerman Senterfitt

(57) ABSTRACT

The invention relates to an integral load support (7) for a jack, said load support which is made of a plain sheet is formed by bending several parts thereof, whereby the bending angle between 2 adjacent bended surfaces (A-L) is less than 180°.

15 Claims, 5 Drawing Sheets

INTEGRAL LOAD SUPPORT FOR A JACK FORMED OF A SHEET MATERIAL BENT TO LESS THAN 180°

THE RELATED ART

This application is a national phase of PCT/TR2009/000132, filed Oct. 28, 2009, and claims priority to TR 2008/08531, filed Nov. 11, 2008, the entire contents of both of which are hereby incorporated by reference.

The invention relates to integral load support formed by bending with bending angle of less than 180° all times at the points of jacks where it contacts chassis of the vehicle in the jacks used for lifting in automobiles and other vehicles for lifting massive loads to a little height or short distance changes of motionless objects by applying big pressure.

BACKGROUND OF THE RELATED ART

With advancement in technology, several lifting and carrying devices have been developed to lift various loads and/or performing works of carrying. Thus, use of muscle force has reduced and performance of such works has been faster and easier. Pulleys, jacks, hoists, cranes and several other similar lifting and carrying devices are available.

Jacks are the tools used to lift massive loads or displace motionless objects to short distances by applying big pressure. Small capacity jacks are used in work benches and automobiles while big capacity jacks are used in lifting heavy machines and other loads.

Jacks are dividing into two groups, namely mechanical jacks and hydraulic jacks. Mechanical jacks have a few types such as screw jacks, rack jacks, . . . .

Hydraulic jacks have some types such as bottle type jacks, horizontal conveyor hydraulic jack.

As known, jacks are usually used for lifting automobiles and similar heavy machines to some height from ground.

Particularly, in case of using jacks in automobiles, the part contacting chassis is called lifting caps. Lifting caps will be referred to as load support hereinafter.

The apparatus used in load supports in the jacks in use today encounter several problems.

The load supports twisted 180° used in the related art undergo thinning and tearing during use and manufacturing.

In the related art it is difficult to produce 180° twisting t load supports in terms of manufacturing. In addition, the extensions and holes arising there from cause problems in interlocking with the vehicle.

When locking by means of twisting of load supports on the jack is used in the related art, deformation and opening on the load supports under the vehicle may occur in case of failure of full twisting.

Mounting the load supports on the jack used in the related art is slow.

The strength rate is low as the locking is made by twisting of load supports at 180° used in the related art. Therefore, the duration of use of jacks is short.

The load supports used in the related art gets deformed quickly and therefore, breaking and cracking may occur. And this causes life risk for users.

In addition, the load supports twisted at 180° in the related art the breaking and cracks occurred during manufacturing are not recognized and if the jack is manufactured or mounted in this way, it causes danger during use.

Another load support used today is the one with two parts. The said two parts are interconnected by twisting. However, having two parts has several disadvantages. As it has two parts, both work flow of manufacturing is slow and costs are quite high. In addition, mounting also takes long time.

Today there are several developments related to jacks and load supports (jack caps). The U.S. Pat. No. 5,697,598 relates to the said jack caps. According to the embodiment, the jack cap is used at the point where the upper supports meet. The jack cap is bended at 180 degrees at point A and is connected to the supports.

As mentioned above, cracking, breaking and other similar deformation occur in the load supports ended at 180° during manufacturing and in time.

Another embodiment is load supports for jacks which is disclosed in U.S. Pat. No. 5,135,201. According to the embodiment, the load cap consists of two pieces.

As mentioned above, manufacturing flow and mounting of two piece load supports take time.

In conclusion, developments have been made in jack caps and, therefore, new embodiments eliminating the above disadvantages and offering solutions to existing systems are needed.

PURPOSE OF THE INVENTION

The present invention relates to a load supports meeting the needs mentioned above, eliminating all disadvantages and providing some additional advantages.

The most important purpose of the invention is to disclose a single piece load support (jack caps) not containing a part bended to 180°. Thus, the thinning, tearing, cracking, deformation in the load support are minimized.

Another purpose of the invention is to disclose a load support providing speeding the work flow of manufacturing and thus increasing costs thereof.

Another purpose of the invention is to disclose a load support preventing deformations, cracking and breaking and thus not risking the life of users.

A further purpose of the invention is to disclose a load support providing easy mounting of the upper arms of the load support and also providing saving in time.

Another purpose of the invention is to provide long life of load supports.

In order to achieve all of the said advantages which will be understood better from the detailed description below, the invention relates to load supports where jacks contact chassis of the vehicle in the jacks used for lifting in automobiles and other vehicles for lifting massive loads to a little height or short distance changes of motionless objects by applying big pressure and thus integral load support formed by bending with bending angle of less than 180 degrees all times is realized.

The structural and characteristics features of the invention and all advantages will be understood better in detailed descriptions with the figures given below and with reference to the figures, and therefore, the assessment should be made taking into account the said figures and detailed explanations.

BRIEF DESCRIPTION OF FIGURES

For better understanding of the embodiment and additional components together with its advantages, it should be considered together with the figures described below.

REFERENCE NUMBERS

Figure 1:
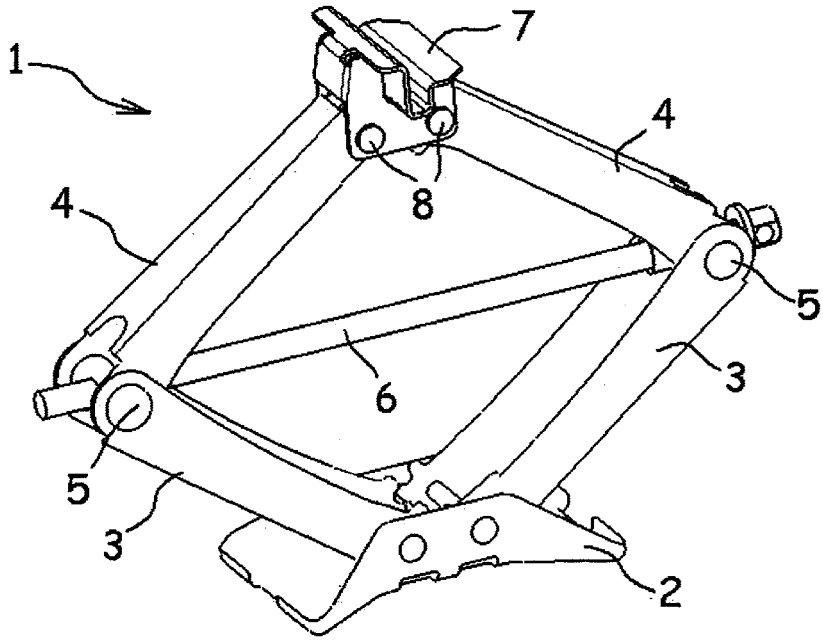
FIG. 1 is a front perspective view of illustrative mounted load support on the jack being subject of the invention.

1. Jack
2. Base member
3. Lower support
4. Upper support
5. Connection means
6. Shaft
7. Load support
8. Connection component
9. First twist line
10. Second twist line
11. Third twist line
12. Fourth twist line
13. First u twist line
14. Second u twist line
15. Bending line
16. Seat housing
16.1. Seat housing angular edge
16.2. Seat edge
16.3. Support Edge
17. Connection hole
18. Centre terminal twist line
19. Centre terminal twist line
20. Surface A edge
21. Surface B edge
A, B, C, D, E, F, G, H, K, L load support surfaces
α bending angle
β angle between X plane and A, B surfaces edges

DETAILED DESCRIPTION OF THE INVENTION

In this detailed description, the preferred embodiments of the load support (7) being subject of this invention have been disclosed solely for the purpose of better understanding of the subject and described in a manner not causing any restrictive effect. FIG. 1 is a front perspective view of illustrative mounted load support (7) on the jack (1) being subject of the invention.

The load support (7) being subject of the invention is the part where the jack (1) contacts the chassis. The said jack (1) embodiment contains a base member (2) facilitating contact with the ground. The said base member (2) is preferably sheet made of metal based material. It consists of lower supports (3) connected to the said base member (2) and connected at certain angles mutually on right and left. Upper supports (4) are provided opposite the said lower supports (3) in a manner symmetric with the said lower supports (3). The said lower supports (3) and upper supports (4) are mounted by use of connection component (5). The said connection component (5) is preferably wedge. In order to provide the connection and operation of the jack (1) a shaft (6) is used in the location where the said lower support (3) and upper support (4) are connected. The load support (7) being subject of the invention where the said upper supports (4) meet contact the jack (1) with the vehicle is twisted and mounted. After the said load support (7) is mounted on the jack (1), it is connected to the connection members (8) which are preferably rivet.

The said load support (7) has twisting lines less than 180°.

The said load support (7) contains A, B, C, D, E, F, G, H, K, L load support surfaces.

The angles between the said surfaces are defined as α bending angle. The angle between surface A and surface B edges (20, 21) and X plane is β.

Figure 2:
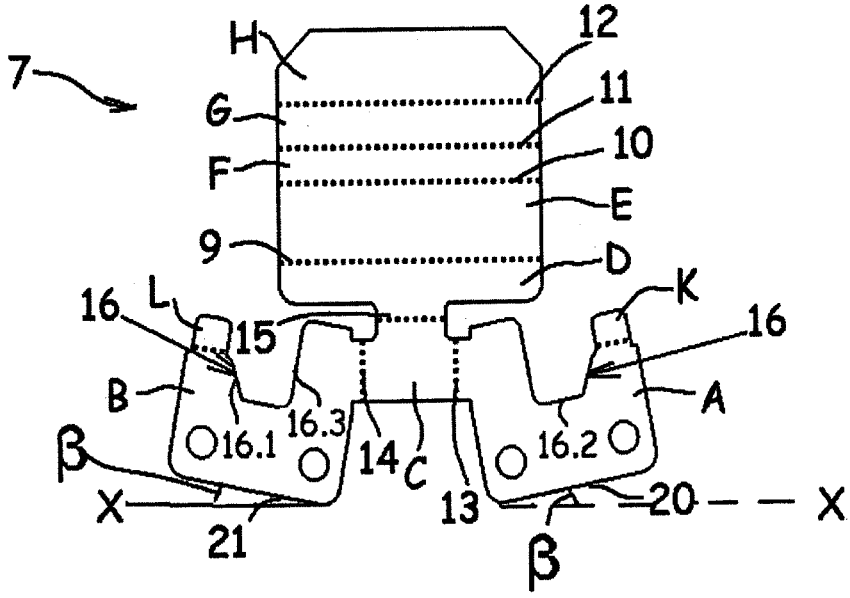
FIG. 2 is a two-dimension view of illustrative not twisted load support being subject of the invention.

The twisting stages of the said load support (7) are as follows;

the said load support (7) shown in FIG. 2 made of a plain sheet part is pressed and load support surfaces of A, B, C, D, E, F, G, H, K, L are formed.

Figure 3:
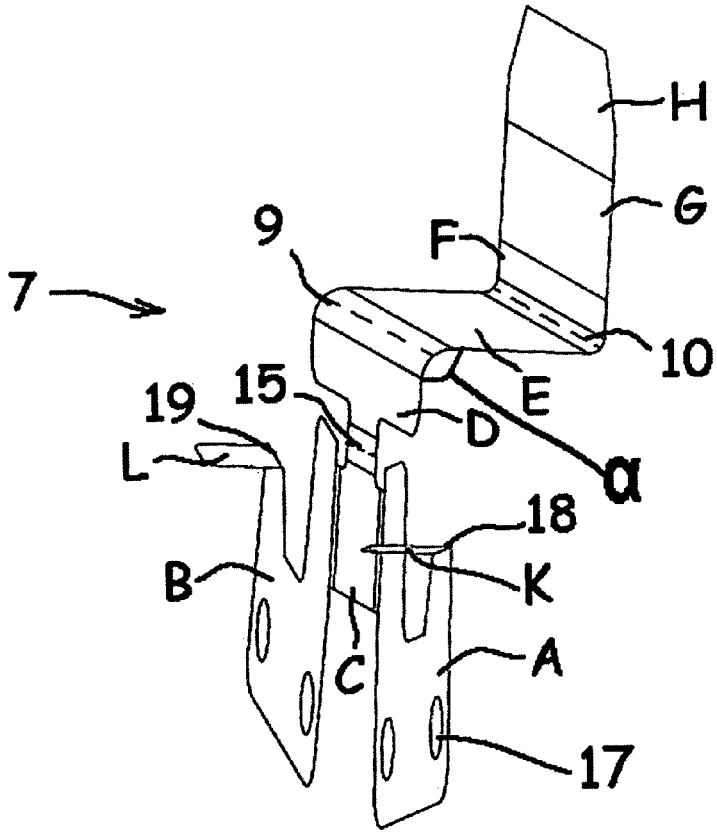
FIG. 3 is a view indicating the load support being subject of the invention from twist 1. and twist 2. line.

As shown in FIG. 3, referring to first twist line (9) between the surface D and surface E, surface E (therefore, surfaces F, G, H in parallel) are bended at −α°. The said α is always less than 180°. In other words, α<180° where preferably, α=90°.

referring to second twist line (10) between E and F, surface F (therefore, surfaces G and H in parallel) is bended at +α° where preferably, α=90°.

Figure 4:
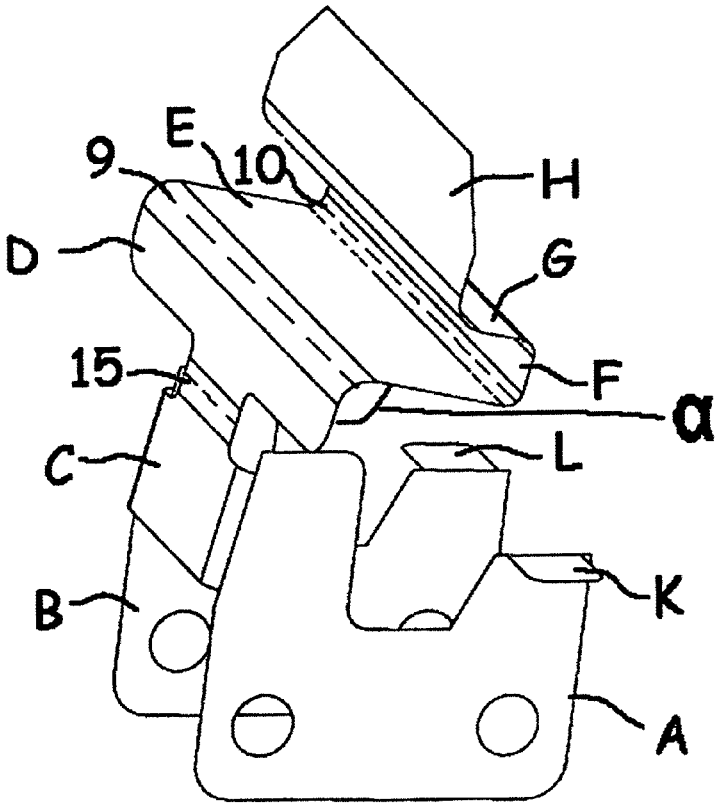
FIG. 4 is the view of the load support indicating the lines to be twisted, centre terminal twisting lines, twist 3 line and twist 4 line.

As shown in FIG. 4, Referring to the third twist line (11) between the surface F and surface G, surface G (therefore, surfaces H in parallel) is bended at +α° where preferably, α=90°.

referring to fourth twist line (12) between G and H, surface H is bended at −α° where preferably, α=90°.

Referring to centre terminal twisting line (18) between A and K, surface K is bended at +α° where preferably, α=90°.

Referring to centre terminal twisting line (19) between B and L, surface L is bended at +α° where preferably, α=90°.

Referring to first u twist line (13) to be u twisted between A and C, surface A is bended at +α° where preferably, α=90°.

Referring to second u twist line (14) to be u twisted between B and C, surface B is bended at −α° where preferably, α=90°.

Referring to bending line (15) between C and D, surface D is bended at −α° where preferably, α=79°

Meanwhile, F surface sits on sitting edge (16.2) formed on the seat housing (16) formed on surfaces A and B, surface E sits on the support edge (16.3) and angular edge (16.1) sits on surface G.

Figure 5:
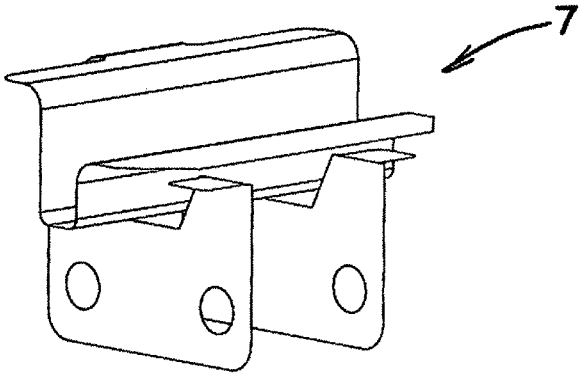
FIG. 5 is a front perspective view of load support being subject of the invention in the status fully twisted.
Figure 6:
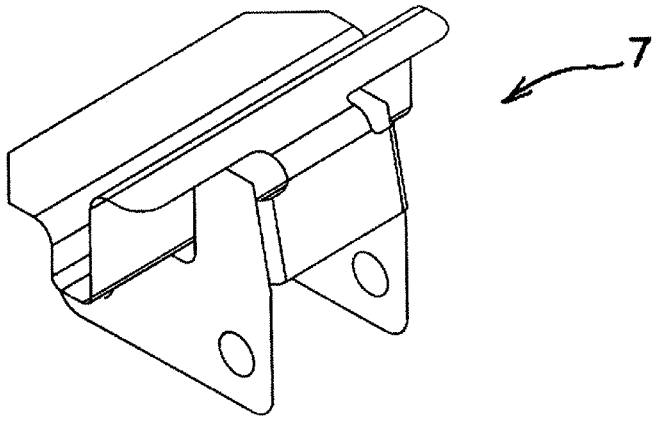
FIG. 6 is a rear perspective view of load support being subject of the invention in the status fully twisted.

The said angular edge (16.1) are bended at the deeper parts to provide twisting. Thus as seen in FIGS. 5 and 6, twisting stages of the load support (7) are completed.

centering process is made between surfaces K and L contacting surface H.

Thus, strength of the load support (7) is increased by locating surface C at the rear.

The invention relates to method for manufacturing integral load support formed by bending with bending angle of less than 180° all times at the points of jacks where it contacts chassis of the vehicle in the jacks used for lifting in automobiles and other vehicles for lifting massive loads to a little height or short distance changes of motionless objects by applying big pressure and it is characterized in that it consists of process steps of:

forming A, B, C, D, E, F, G, H, K, L load support (7) surfaces

Referring to the first twist line (9) between the surface D and surface E, bending surface E (therefore, surfaces F, G, H in parallel) −α° referring to second twist line (10) between E and F, surface F (therefore, bending the surfaces G and H in parallel) at +α°

Referring to the third twist line (11) between the surface F and surface G, bending the surface G (therefore, surfaces H in parallel) at +α°;

Referring to fourth twist line (12) between G and H, bending surface H at $-\alpha°$;

Referring to centre terminal twisting line (18) between A and K, bending the surface K at $+\alpha°$;

Referring to centre terminal twisting line (19) between B and L, bending the surface L at $+\alpha°$;

Referring to twisting line (13) to be u twisted between A and C, bending the surface A at $+\alpha°$;

Referring to twisting line (14) to be u twisted between B and C, bending the surface B at $-\alpha°$ Referring to bending line (15) between C and D, bending the surface D $-\alpha°$;

sitting of surface F on sitting edge (16.2) of seat housing (16) in surfaces A and B, sitting of surface E on support edge (16.3) and sitting of surface G on angular edge (16.1)

centering surfaces K and L contacting surface H and connection.

The protection area of this application has been specified under claims and cannot be limited to the descriptions only given as sampling above. It is clear that any innovation can be provided by a person skilled in the related art by use of the similar embodiments and/or can also apply this embodiment in other areas for similar purposes used in the related art. Therefore, such embodiments will be lack of innovation criteria and particularly exceeding the related art.

The invention claimed is:

1. A load support for a jack for lifting automobiles and other vehicles consisting of an integral load support formed of a sheet material bent in a manner such that the bending angle between two adjacent surfaces $\alpha<180°$ and comprising:

load support surfaces A, B, C, D, E, F, G, H, K, and L;

a first bend line between surfaces D and E, formed by bending surface E at $-\alpha°$ with surfaces F, G, and H remaining parallel with surface E;

a second bend line between surfaces E and F, formed by bending surface F at $+\alpha°$ with surfaces G and H remaining parallel with surface F;

a third bend line between surfaces F and G, formed by bending surface G at $+\alpha°$ with surface H remaining parallel with surface G;

a fourth bend line between surfaces G and H, formed by bending surface H at $-\alpha°$;

a first centre terminal bend line between surfaces A and K, formed by bending surface K laterally outwardly at $+\alpha°$;

a second centre terminal bend between surfaces B and L, formed by bending surface L laterally outwardly at $+\alpha°$;

a u-bend line between surfaces A and C, formed by bending surface A at $+\alpha°$;

a u-bend line between surfaces B and C, formed by bending surface B at $-\alpha°$;

a bend line between surfaces C and D, formed by bending surface D at $-\alpha°$;

wherein surface F sits on a sitting edge of a seat housing formed by surfaces A and B, surface E sits on a support edge of the seat housing, and surface G sits on an angular edge of the seating housing; and wherein surfaces K and L are centered and surface H sits on surfaces K and L.

2. The load support according to claim 1, said seat housing defining:

sitting edges where a generally horizontal support surface F sits, a sitting edge where a generally vertical support surface E sits, and an angular edge where a generally vertical support surface G sits.

3. The load support according to claim 2, comprising an angle $\beta$ between a plane X and edges of surfaces A and B.

4. The load support according to claim 2, comprising generally horizontal support surfaces H, K and L, surface H extending from surface G, and surfaces K and L extending from surfaces A and B, wherein surface H rests on surfaces K and L and provide a connection after surfaces of A, B, C, D, E, F, G, of the load support are bent at $\alpha<180°$.

5. The load support according to claim 4, wherein surfaces H and K, L are directed towards the center of the load support and are connected.

6. A method for manufacturing a load support for a jack for lifting automobiles and other vehicles consisting of an integral load support formed of a sheet material bent in a manner such that the bending angle between two adjacent surfaces $\alpha<180°$ and comprises the process steps of:

forming load support surfaces A, B, C, D, E, F, G, H, K, and L by:

making a first bend line between surfaces D and E, by bending surface E at $-\alpha°$ with surfaces F, G, and H remaining parallel with surface E;

making a second bend line between surfaces E and F, by bending surface F at $+\alpha°$ with surfaces G and H remaining parallel with surface F;

making a third bend line between surfaces F and G, by bending surface G at $+\alpha°$ with surface H remaining parallel with surface G;

making a fourth bend line between surfaces G and H, by bending surface H at $-\alpha°$;

making a first centre terminal bend line between surfaces A and K, by bending surface K laterally outward at $+\alpha°$;

making a second centre terminal bend line between surfaces B and L, by bending surface L laterally outward at $+\alpha°$;

making a u-bend line between surfaces A and C, by bending surface A at $+\alpha°$;

making a u-bend line between surfaces B and C, by bending surface B at $-\alpha°$;

making a bend line between surfaces C and D, by bending surface D at $-\alpha°$;

sitting surface F on a sitting edge of a seat housing formed by surfaces A and B, sitting surface E on a support edge of the seat housing, and sitting of surface G on an angular edge of the seating housing; and centering surfaces K and L and sitting surface H on surfaces K and L.

7. The load support manufacturing method according to claim 6, wherein referring to the first bend line between the surface D and surface E, surface E is bent at $-\alpha=90°$.

8. The load support manufacturing method according to claim 6, wherein referring to the second bend line between the surface E and surface F, surface F is bent at $+\alpha=90°$.

9. The load support manufacturing method according to claim 6, wherein referring to the third bend line between the surface F and surface G, surface G is bent at $+\alpha=90°$.

10. The load support manufacturing method according to claim 6, wherein referring to the fourth bend line between the surface G and surface H, surface H is bent at $-\alpha=90°$.

11. The load support manufacturing method according to claim 6, wherein referring to the terminal bend line between the surface A and surface K, surface K is bent at $+\alpha=90°$.

12. The load support manufacturing method according to claim 6, wherein referring to the terminal bend line between the surface B and surface L, surface L is bent $+\alpha=90°$.

13. The load support manufacturing method according to claim 6, wherein referring to the u-bend line between the surface A and surface C, surface A is bent $+\alpha=90°$.

14. The load support manufacturing method according to claim 6, wherein referring to the u-bend line between the surface B and surface C, surface B is bent at $-\alpha=90°$.

15. The load support manufacturing method according to claim 6, wherein referring to the bend line between the surface C and surface D, surface D is bent at $-\alpha=79°$.

* * * * *